United States Patent [19]

Ross

[11] 4,273,640

[45] Jun. 16, 1981

[54] ZINC EXTRACTION APPARATUS

[76] Inventor: Richard H. C. LeB. Ross, 1701 Avoca Apartments, 10 Avoca Ave., Toronto, Ontario, Canada, M4T 2B7

[21] Appl. No.: 96,354

[22] Filed: Nov. 21, 1979

Related U.S. Application Data

[60] Division of Ser. No. 863,190, Dec. 22, 1977, Pat. No. 4,183,794, and a continuation-in-part of Ser. No. 777,270, Mar. 14, 1977, abandoned.

[51] Int. Cl.[3] ..... C25D 17/02; C25D 21/12; C25D 17/12

[52] U.S. Cl. ..... 204/216; 204/228; 204/267; 204/268; 204/269

[58] Field of Search ..... 204/224 R, 271, 267–270, 204/114, 212, 216, 218, 119, 217

[56] References Cited

U.S. PATENT DOCUMENTS

| | | | |
|---|---|---|---|
| 467,484 | 1/1892 | Stalmann | 204/108 |
| 798,790 | 9/1905 | Hering | 204/115 X |
| 2,374,449 | 4/1945 | Mulcahy | 204/268 X |
| 2,590,927 | 4/1952 | Brandt et al. | 204/224 R X |
| 3,616,277 | 10/1971 | Adamson et al. | 204/216 X |

*Primary Examiner*—Delbert E. Gantz

*Assistant Examiner*—D. R. Valentine

*Attorney, Agent, or Firm*—Rogers, Bereskin & Parr

[57] ABSTRACT

An apparatus for use in extracting primary zinc metal from ore concentrates is described. The apparatus includes first and second electrolytic cells, the first cell receiving an acid zinc sulfate solution derived from an ore concentrate, and having an anode which is insoluble in said solution, and the second cell containing an alkaline electrolyte and having a cathode which is insoluble in said electrolyte. A common electrode is also provided which is insoluble both in the acid zinc sulfate solution and in the alkaline electrolyte. The common electrode can be transferred between the first cell, in which it acts as a cathode, and the second cell, in which it acts as an anode. The zinc sulfate solution is subjected to electrolysis in the first cell with the common electrode acting as a cathode, thereby causing primary zinc metal to be deposited as a coating on the common electrode. The coated common electrode is transferred from the first cell to the second cell and the alkaline electrolyte in the second cell is subjected to electrolysis so that the primary zinc metal is transferred from the common electrode to the cathode of the second cell in a sponge-like form. The zinc sponge is mechanically removed from the cathode of the second cell.

5 Claims, 10 Drawing Figures

FIG. 4
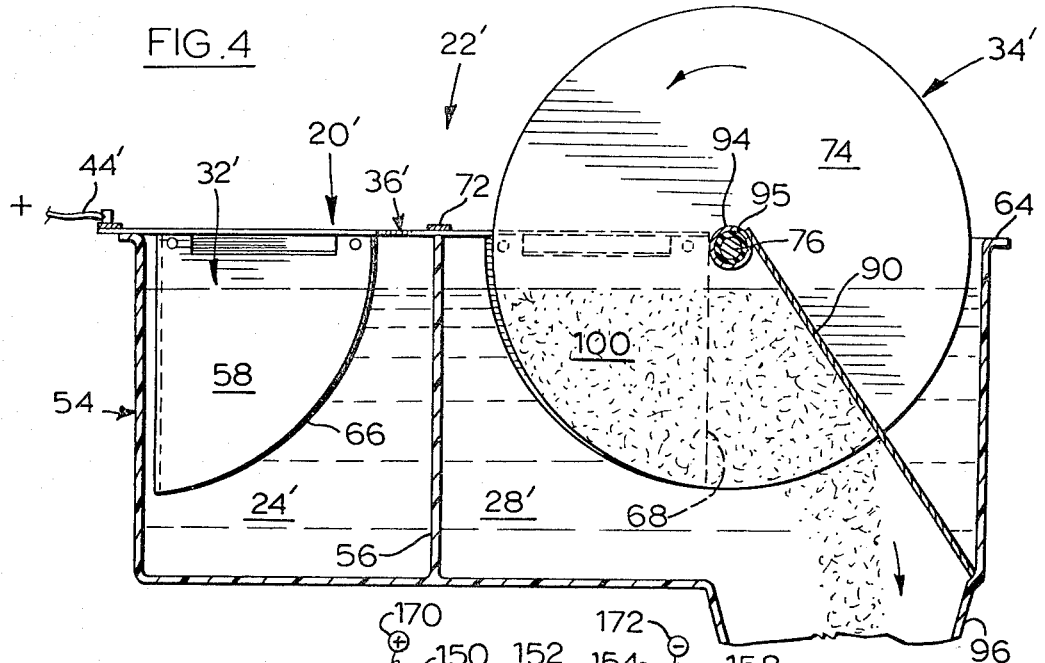
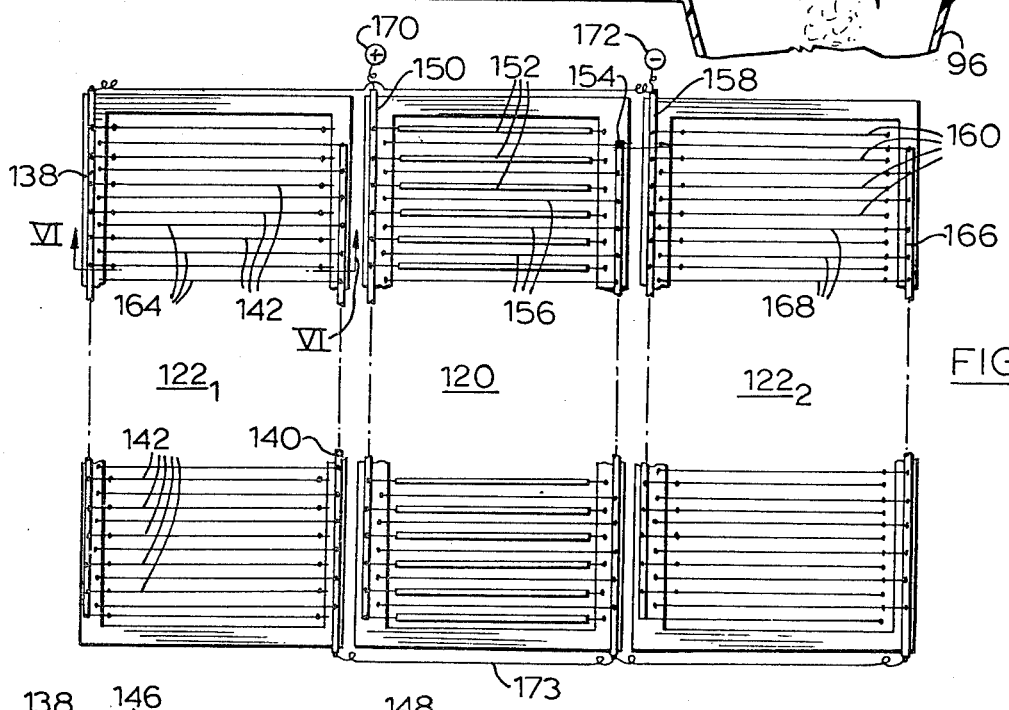
FIG. 5
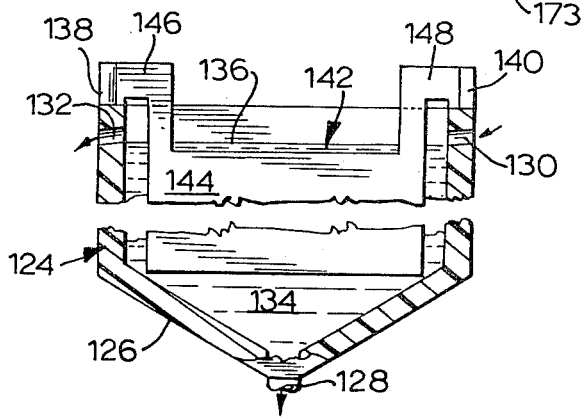
FIG. 6

ZINC EXTRACTION APPARATUS

This is a division of application Ser. No. 863,190 filed Dec. 22, 1977 now U.S. Pat. No. 4,183,794, and a continuation-in-part of application Ser. No. 77,270 filed Mar. 14, 1977, now abandoned.

This invention relates to an apparatus for extracting primary zinc metal from ore concentrates.

Applicant is aware of the following United States patents which have been considered in the preparation of this application:

U. S. Pat. Nos. 923,411, 1,254,056, 1,397,088, 1,959,376, 2,122,876, 2,655,472; 2,326,783, 3,616,277, 3,788,965, and 3,808,117.

In commercial plants, zinc metal is commonly extracted by electrowinning from an aqueous zinc sulfate solution derived from an ore concentrate. The solution is produced by treating roasted zinc ore concentrate with sulfuric acid to leach zinc oxide from the ores. Purified zinc sulfate solution is the starting material for the electrowinning process. The process is performed in a cell having a series of insoluble anodes and aluminum cathodes called "starting sheets." An electric current applied across the cell causes zinc metal to be deposited on the cathodes. Sulfuric acid is regenerated in the cell and is recycled for use in the leaching operation referred to previously.

A significant disadvantage of the electrowinning process is that the zinc is deposited on the aluminum cathodes (starting sheets) in the form of closely adherent zinc layers which are difficult to remove. In most plants, the stripping operation is performed manually. Many thousands of these sheets have to be individually stripped, usually every 24 hours, in a typical plant. This highly labour-intensive phase of the overall process is extremely costly. Attempts have been made to mechanize the stripping operation but have been unsuccessful in achieving significant cost reductions.

An object of the present invention is to provide an apparatus for use in extracting primary zinc metal from an ore concentrate, which can be used to avoid this problem.

The apparatus includes first and second electrolytic cells, the first cell being intended to receive the acid zinc sulfate solution and having an anode which is insoluble in the solution, and the second cell containing an alkaline electrolyte and having a cathode which is insoluble in said electrolyte. The apparatus also includes a common electrode which is insoluble both in the acid zinc sulfate solution and in the alkaline electrolyte and which can be transferred between the first cell, in which the electrode acts as a cathode, and the second cell, in which the electrode acts as an anode.

In order that the invenion may be more clearly understood, reference will now be made to the accompanying drawings which diagrammatically illustrate a number of preferred embodiments of the invention by way of example. In the drawings:

FIGS. 1*a* to 1*c* are diagrammatic views intended to illustrate three sequential steps in the method of the invention;

FIG. 4 is a vertical sectional view on line IV—IV of FIG. 2;

FIG. 5 is a plan view of an apparatus according to a further embodiment of the invention;

FIG. 6 is a vertical sectional view generally on line VI—VI of FIG. 5;

Figure 1A:
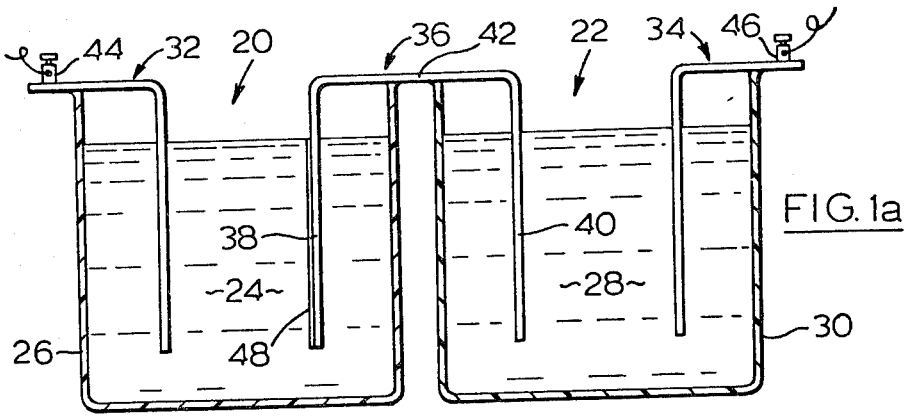
Figure 1B:
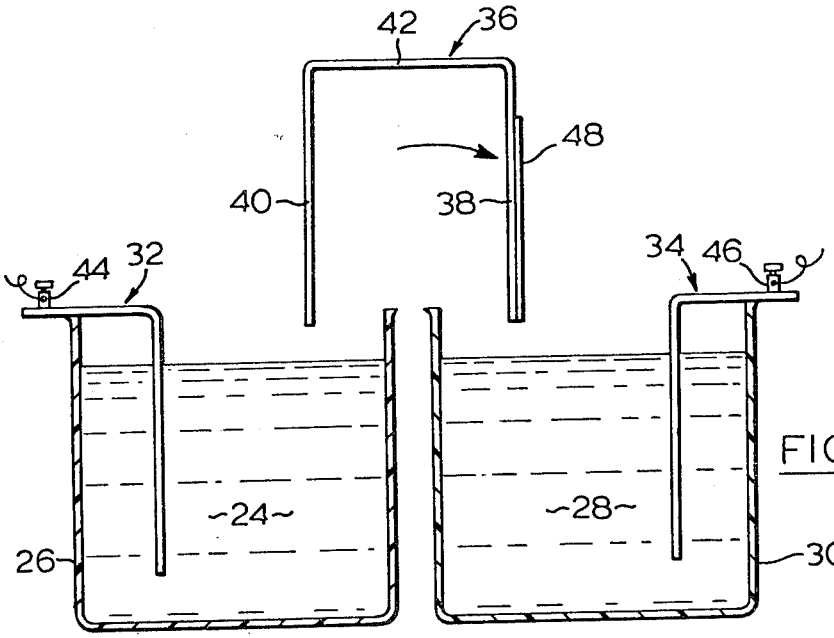
Figure 1C:
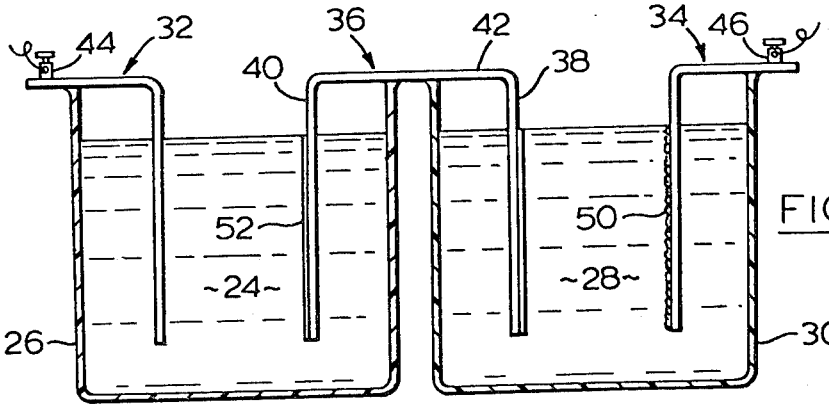

In FIGS. 1*a* to 1*c*, two electrolytic cells are indicated at 20 and 22. It is to be understood that these cells are shown merely diagrammatically in the drawings for the purpose of explaining the principle of the invention and are not to be considered as accurate representations of cells which would be used in practice.

Cell 20 is an acid cell and has an electrolyte 24 of acid zinc sulfate solution disposed in a container 26. Cell 22 is an alkaline cell and has an electrolyte 28 of sodium hydroxide solution in a container 30. Acid cell 20 has a fixed lead anode 32 while cell 22 has a fixed cathode 34 of stainless steel.

A compound electrode generally denoted 36 is used in association with the cells 20 and 22 and is of inverted U-shape, having first and second limbs 38 and 40 which in effect define two individual electrodes electrically coupled by a bridging portion 42. In FIG. 1*a*, electrode 38 is shown in the acid sulfate solution 24 of cell 20, while electrode 40 is immersed in the sodium hydroxide solution 28 of cell 22. The bridging portion 42 between the electrodes 38 and 40 rests on the upper edges of the respective containers 26 and 30. Electrode 36 is made of a single piece of stainless steel and as such is insoluble in both electrolytes. A source of direct electric current is connected across the cell with the positive side of the source, indicated at 44, connected to the anode 32 of acid cell 20, and the negative side of the source, indicated at 46, connected to the cathode 34 of the alkaline cell 22.

The acid zinc sulfate solution 24 in the acid cell 20 is the product of a conventional leaching and purification operation such as that discussed previously, in which roasted zinc ore concentrate is treated with sulfuric acid. When the directed current source is connected across the two cells, the zinc sulfate solution 24 is electrolysed and zinc is progressively deposited on the first electrode 38. The zinc is deposited in the form of a closely adherent layer such as that indicated at 48. By the process of depositing the zinc on the electrode 38, sulfuric acid is regenerated in the electrolyte and may be removed from the cell for use in the leaching operation referred to previously.

When the deposition process is complete, the compound electrode 36 is removed from the cells and the regenerated sulfuric acid in cell 20 is replaced by fresh acid zinc sulfate solution. Electrode 36 is then reversed as indicated in FIG. 1 *b* and replaced in the cells with the first electrode 38 (coated with the zinc layer 48) immersed in the electrolyte 28 of the alkaline cell and the second electrode 40 immersed in the acid zinc sulfate solution. The alkaline electrolyte 28 in cell 22 is subjected to electrolysis, which causes the zinc in layer 48 to be progressively dissolved from electrode 38 and transferred through the electrolyte to the cathode 34 of the alkaline cell 22, on which it is deposited in a sponge-like form of dendritic zinc crystals. The layer of sponge-like zinc on cathode 34 is indicated at 50 in FIG. 1*c*. Zinc in this form is readily removed from the cathode by light mechanical action such as scraping or hydraulic flushing. In this embodiment, cathode 34 would be removed from cell 22 during this operation.

It will be appreciated that, in the illustrated embodiment, the compound electrode 36 serves to electrically couple the two cells in series so that the respective electrolytic processes can proceed simultaneously. Accordingly, while the zinc layer 48 is being stripped from electrode 38 in cell 22, zinc is being deposited on electrode 40 in the acid cell 20. A closely adherent zinc layer on electrode 40 is denoted 52 in FIG. 1*c*. By virtue of the interconnection between the two cells, the electrolytic processes in the two cells will proceed at the same rate, with the result that layer 48 will have been removed by the time layer 52 is being deposited. At this stage, the compound electrode 36 can again be reversed (after replacement of the electrolyte in the acid cell 20) so that layer 52 on electrode 40 can be stripped in the alkaline cell 22 while a new zinc layer is deposited on electrode 38 in the acid cell 20.

Figure 2:
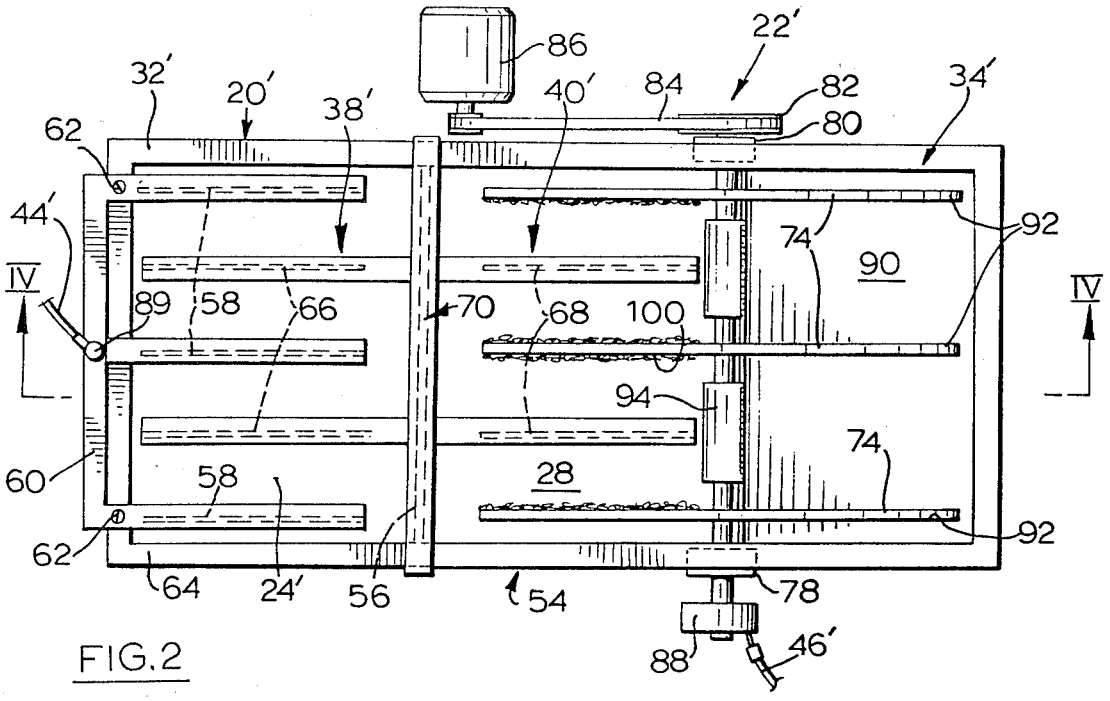
FIG. 2 is a plan view of an apparatus for performing the method.
Figure 3:
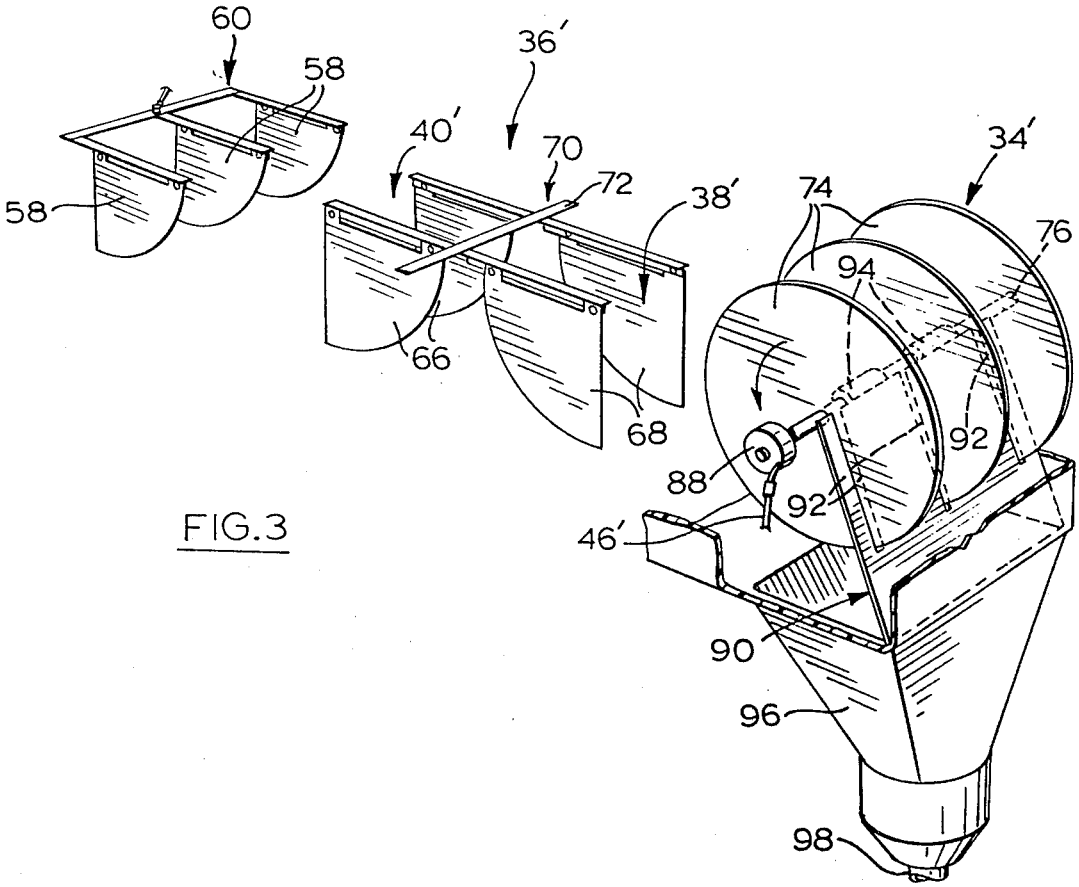
FIG. 3 is a perspective view of the electrodes of the apparatus of FIG. 2.

Reference will now be made to FIGS. 2 to 4 in describing a commercial prototype apparatus which has been used to perform the method described with reference to FIGS. 1*a* to 1*c*. Primed reference numerals will be used in FIGS. 2 to 4 denote parts which correspond with parts in the previous views.

The apparatus of FIGS. 2 to 4 includes a tank 54 divided internally by a vertical wall 56 into two compartments which respectively define an acid cell 20' and an alkaline cell 22'. Acid zinc sulfate electrolyte 24' is shown in cell 20' while sodium hydroxide electrolyte is shown at 28' in cell 22'. In this embodiment, multiple electrodes are used in the respective cells. The anodes of acid cell 20' are generally indicated at 32' while the cathodes of alkaline cell 22' are indicated at 34'. Similarly, a compound electrode is shown at 36'. The electrodes are shown individually in perspective in FIG. 3. It will be seen that the acid cell anodes 32' comprise three anode plates 58 made of lead and fastened to a carrier plate 60. Frame 60 is removably attached by screws 62 (FIG. 2) to a lip 64 of the tank 54. The compound electrode 36' includes two individual assemblies 38' and 40 (as in the previous embodiment), each having two electrode plates. The plates of assembly 38' are denoted 66 while the plates of assembly 40' are denoted 68. The plates are fastened to a carrier frame generally denoted 70, which includes a transverse plate 72 arranged to rest on the upper edge of the internal wall 56 of tank 54 to support the electrode plates in the respective cells.

The cathode 34' of the alkaline cell comprises three circular cathode discs 74 secured to a shaft 76 which extends transversely of the tank 54 above the electrolyte 28'. Shaft 76 is mounted at its ends in bearings 78 and 80 attached to the tank 54 and has a pulley 82 (FIG. 2) at one end. Pulley 82 is driven by a belt 84 from a conventional electric motor 86 mounted externally of the tank. The size of the drive pulley for shaft 76 and the speed of the motor 86 are chosen so that the cathode discs 74 rotate slowly in the electrolyte 28' of alkaline cell 22'. At its end remote from pulley 82, shaft 76 is fitted with a slip-ring type electric contact device 88 coupled to the negative side of a DC current source. The positive side 44' of the source is connected to the anodes 32' of acid cell 20' by way of a terminal 89.

To summarize, in the particular embodiment illustrated, three acid cell anode plates 58 and three alkaline cell cathode discs 74 are employed, while each common electrode assembly 38', 40' of the compound electrode 36' includes two electrode plates. Referring to FIG. 2, two electrode plates 66 are disposed between the three acid cell anode plates 58, and the two electrode plates 68 are located between the three cathode discs 74 of the alkaline cell. This arrangement allows zinc layers to be deposited on both sides of the electrode plates 66 in the acid cell and on the inner faces of the outer cathode discs 74 and on both faces of the centre cathode disc in the alkaline cell. Some deposition will also take place on the outer faces of the outer cathode discs. However, the primary deposition areas are those in which one of the electrode plates of the compound electrode 36' is disposed directly facing the relevant cathode disc face. For the same reason, each of the electrode plates 58, 66 and 68 has the shape of a quarter segment of a circle of a diameter corresponding to the diameters of the cathode discs 74. Accordingly, as the cathode discs rotate, each side of each electrode plate 68 in effect "covers" the whole of the area of the relevant face of one cathode disc 74 so that the zinc is deposited over the whole of that area.

The apparatus of FIGS. 2 to 4 also includes a scraper plate for removing the sponge-like zinc deposited on the cathode discs 74. The plate is indicated at 90 in the drawings and is arranged in an inclined position between the shaft 76 carrying the cathode discs 74 and the bottom right hand "corner" of tank 54 as viewed in FIG. 4. Plate 90 is formed with three slots 92 in which the cathode discs 74 rotate and which are dimensioned so that the portions of the plates defining the slots scrape the faces of the discs. Welded to the upper edge of plate 90 are two collars 94 filled with electrically insulating sleeves 95 through which shaft 76 extends and which allow the shaft to rotate relative to plate 90. The cathode discs 74 rotate in the counter-clockwise direction as viewed in FIGS. 3 and 4 so that zinc "sponge" on the discs is scraped off at the underside of plate 90 and settles by gravity in the alkaline cell compartment of tank 54. A funnel 96 is inset into the bottom wall of the tank below the cathode discs to catch the zinc. A pipe 98 attached to the funnel is secured with its outer end (not shown) above the level of the electrolyte in the alkaline cell so that the electrolyte will not drain out of the cell. When the zinc sponge is to be recovered, the pipe is lowered to allow the electrolyte to run out through funnel 96 and permit recovery of the zinc sponge by filtering.

The apparatus shown in FIGS. 2 to 4 operates in similar fashion to the cells described with reference to FIGS. 1*a* to 1*c*. Accordingly, the electrolyte 24' in the acid cell 20' is acid zinc sulfate solution and is subjected to electrolysis in the acid cell, which causes closely adherent zinc layers (not shown) to be deposited on the inner and outer faces of the electrode plates 66 of compound electrode 36'. When the deposition process is complete, electrode 36' is reversed so that the zinc coated electrode plates 66 are disposed in the alkaline cell 22'. In that cell, the zinc is transferred from the electrode plates 66 and deposited in sponge-like form on the cathode discs 74 as they rotate. Some of this zinc is indicated at 100 in FIG. 2 and is shown on the inner faces of the outer cathode discs 74 and on both faces of the centre discs. The discs are continuously coated with sponge-like zinc as they rotate and the zinc is continually scraped off the discs by the scraper plate 90 and collected in the funnel 96 as described above. Also, as described above, the two cells 20' and 22' will normally operate simultaneously so that zinc is deposited on the compound electrode 36' in the acid cell while previously deposited zinc layers are simultaneously being stripped from other plates of the compound electrode in the alkaline cell.

Reference will now be made to FIGS. 5 and 6 in describing a further embodiment of the invention. These views are diagrammatic illustrations of a proposed commercial installation for extracting primary zinc metal in accordance with the method of the invention. The installation shown in these views has been designed to take advantage of the fact that the voltage level (and hence the power consumption) in the alkaline cell of the invention is much lower than in the acid cell. This is because, in the alkaline cell, "corrosion" of the coherent zinc coating on the common electrode electrically balances deposition of zinc "sponge" on the cathode. Also, it has been found experimentally that the alkaline cell voltage can be kept at substantially lower average voltage by keeping the current density at half the current density normally used in the acid cell electrowinning operation. Accordingly, the installation of FIGS. 5 and 6 has been designed to provide two alkaline cells in association with a single acid cell. Each alkaline cell is run at a current density of half the current density in the acid cell, thereby minimizing voltage and hence overall power consumption. Zinc is deposited in the acid cell at twice the rate at which zinc is stripped in each alkaline cell. To accommodate this, three sets of common electrodes are provided for transfer between the acid cell and the alkaline cells as will be described.

In FIG. 5, the acid cell of the installation is denoted by numeral 120 while the two alkaline cells are denoted $\mathbf{122_1}$ and $\mathbf{122_2}$ respectively. FIG. 6 shows a sectional view through the alkaline cell $\mathbf{122_1}$ and may be considered as representative of all three cells. The cell includes a rectangular tank 124 having a funnel shaped bottom wall 126 provided with a central drain opening 128 which is normally closed when the cell is in operation. Filling and overflow openings 130 and 132 respectively are provided in the side walls of the tank. The electrolyte is indicated at 134 and the level of its surface is denoted 136. In the case of cells $\mathbf{122_1}$ and $\mathbf{122_2}$, the electrolyte is sodium hydroxide solution, while in the case of cell 120, the electrolyte is acid zinc sulfate solution.

Two bus bars 138 and 140 extend longitudinally of the tank 124 and are disposed on top of the side walls thereof. A plurality of electrodes are disposed in the cell, alternate electrodes being coupled to one of the bus bars while the intervening electrodes are coupled to the other bus bar. A typical electrode is indicated at 142 in FIG. 6 and includes a main rectangular portion 144 which is submerged in the electrolyte in the tank, and two upstanding support portions 146 and 148, each of inverted L-shape. The electrode is coupled to the appropriate one of the bus bars 138 or 140 by way of the relevant support portion 146 or 148. The other support portion rests on the top of the opposite wall of the tank. In FIG. 6, electrode 142 is in fact a cathode and its support portion 146 is coupled to bus bar 138, while the other support portion 148 rests on the top edge of the opposite side wall of the tank.

Referring back to FIG. 5, it will be seen that each of the cells includes two bus bars and a plurality of electrodes extending between opposite longitudinal walls of the tank as described in connection with FIG. 6. In the case of the acid cell 120, the bus bar which is shown at the left is an anode bus bar and is denoted 150. A plurality of anodes similar to electrode 142 of FIG. 6 are coupled to bus bar 150 and are denoted 152. The other bus bar of acid cell 120 is denoted 154 and forms part of a compound electrode assembly which is transferable between the acid cell and either of the alkaline cells in the manner of the compound electrodes 36 and 36' described previously. A plurality of electrodes 156, again similar to electrode 142 of FIG. 6 extend between bus bar 154 on the opposite side of the tank of the acid cell and are coupled to the bus bar. Accordingly, when the acid cell is in operation, the acid zinc sulfate solution is electrolysed and closely adherent zinc coatings are deposited on the electrodes 156. The electrodes, together with the bus bar 154, are then lifted as a unit from the acid cell and placed in one of the alkaline cells.

Each of the alkaline cells has a cathode bus bar fitted with a plurality of cathodes similar to those shown in FIG. 6. As indicated previously, the cathode bus bar for cell $\mathbf{122_1}$ is denoted 138 and the cathodes are denoted 142. The cathode bus bar for cell $\mathbf{122_2}$ is denoted 158 and the cathodes are indicated at 160. Each alkaline cell also is fitted with a compound electrode assembly comprising a bus bar and electrodes similar to those indicated at 154 and 156 in the case of the acid cell. The compound electrode in cell $\mathbf{122_1}$ comprises bus bar 140 and a plurality of electrodes 164. In the case of cell $\mathbf{122_2}$, the compound electrode bus bar is denoted 166 and the electrodes 168. The positive side of a DC current source is indicated at 170 and the negative side of the same source is indicated at 172. Note that the common electrode bus bars 154, 140 and 166, in cells 120, $\mathbf{122_1}$ and $\mathbf{122_2}$ are interconnected as shown at 173 in FIG. 5. The bus bars are connected to the DC source so that the alkaline cells are in parallel with one another and in series with the acid cell. The alkaline cells are essentially similar to one another, with the result that the current flowing through each alkaline cell is half the current flowing through the acid cell. Accordingly, the power consumption of the overall installation is minimized. In a typical example, the current flowing through the acid cell would be 11,520 amps at a voltage of between 3.5 and 5 volts, while the current flowing through each alkaline cell would be 5,760 amps. Each cathode in each alkaline cell has an immersed area of 2 feet by 3 feet on each side, making a total immersed area per cathode of 12 square feet. There are twenty-four cathodes in each cell which equals a total cathode area of 288 square feet per cell. Accordingly, the current desnity in each alkaline cell is 20 amps per square foot. A similar calculation for the acid cell indicates a current density of 40 amps per square foot.

The installation shown in FIGS. 5 and 6 operates as follows. Acid zinc sulfate solution in acid cell 120 is electrolysed, causing coherent zinc coatings to be deposited on the electrode plates 156 of the compound electrode. At the end of the deposition process, the compound electrode is transferred to one of the alkaline cells, say cell $\mathbf{122_1}$. A compound electrode from that alkaline cell is inserted in the acid cell and the acid electrolyte is replaced. Since the current density in the alkaline cell $\mathbf{122_1}$ is half the current density in the acid cell 120, the operation of stripping the coherent zinc coatings in the alkaline cell will take twice as long as the deposition of the coatings in the acid cell. If for example, the zinc deposition in the acid cell takes twenty-four hours, the stripping operation in cell $\mathbf{122_1}$ will take forty-eight hours. At the end of the twenty-four hour period, the deposition process will be complete and the compound electrode in the acid cell will be ready for removal. However, the stripping process in cell $122_1$ will only be half completed. Accordingly, the compound electrode from the acid cell is then placed in the other alkaline cell $122_2$ and the compound electrode from that cell is placed in the acid cell. After a futher twenty-four hour period, the deposition process in the acid cell will be complete as will the stripping process in the alkaline cell $122_1$. The compound electrodes in those two cells will then be interchanged. The stripping process in alkaline cell $122_2$ will be half completed at this time and the compound electrode in that cell will be removed after a further twenty-four hours when the deposition process in cell 120 will have been completed. It will be appreciated from this description that the deposition and stripping operations can proceed in this sequence on a substantially continuous basis.

The operation of stripping from the cathode plates the sponge-like zinc deposited in the alkaline cells can be effected in a variety of ways, for example by hydraulic flushing of the cell tank, or mechanically with a "gang" scraper operated by an overhead crane. Alternatively, the bank of cathodes and accompanying bus bar may be bodily removed from the cell by the overhead crane and lowered through a "comb" of scrapers in a special stripping tank.

Figure 7:
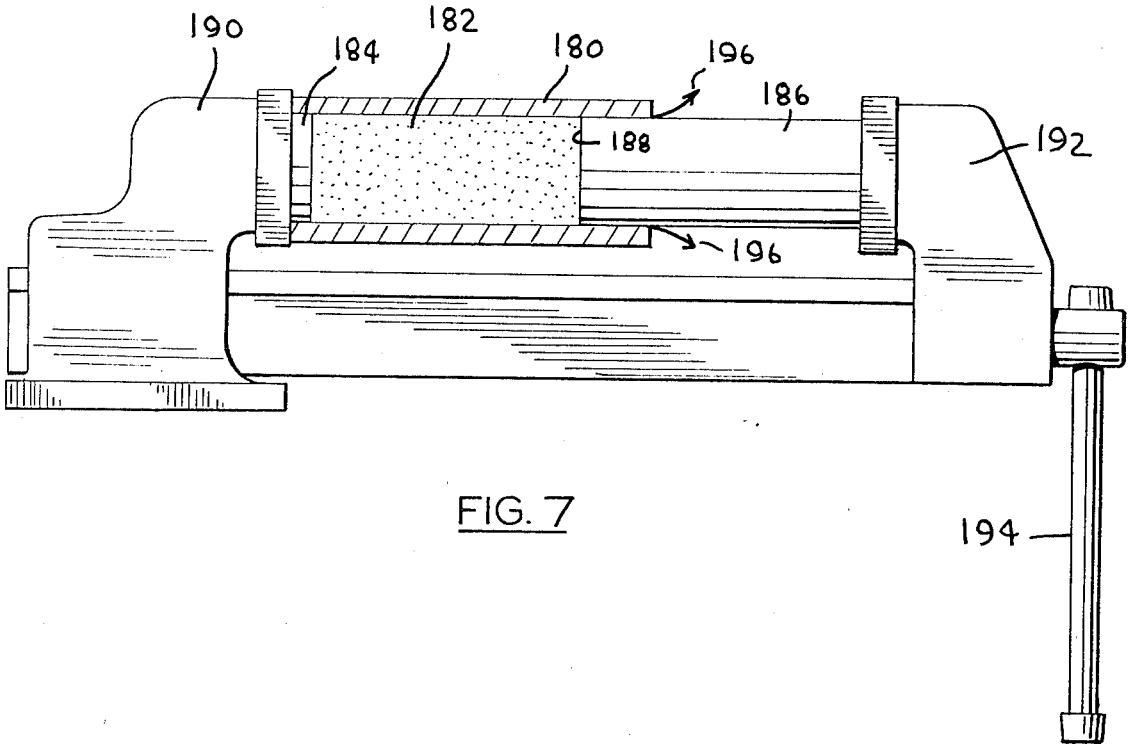
FIG. 7 is a diagrammatic side view, partly in section, of an experimental apparatus for processing zinc sponge produced by the apparatus illustrated in any of the previous views; and, FIG. 8 is a view similar to FIG. 7, illustrating ejection of a slug of zinc from the apparatus of FIG. 7.
Figure 8:
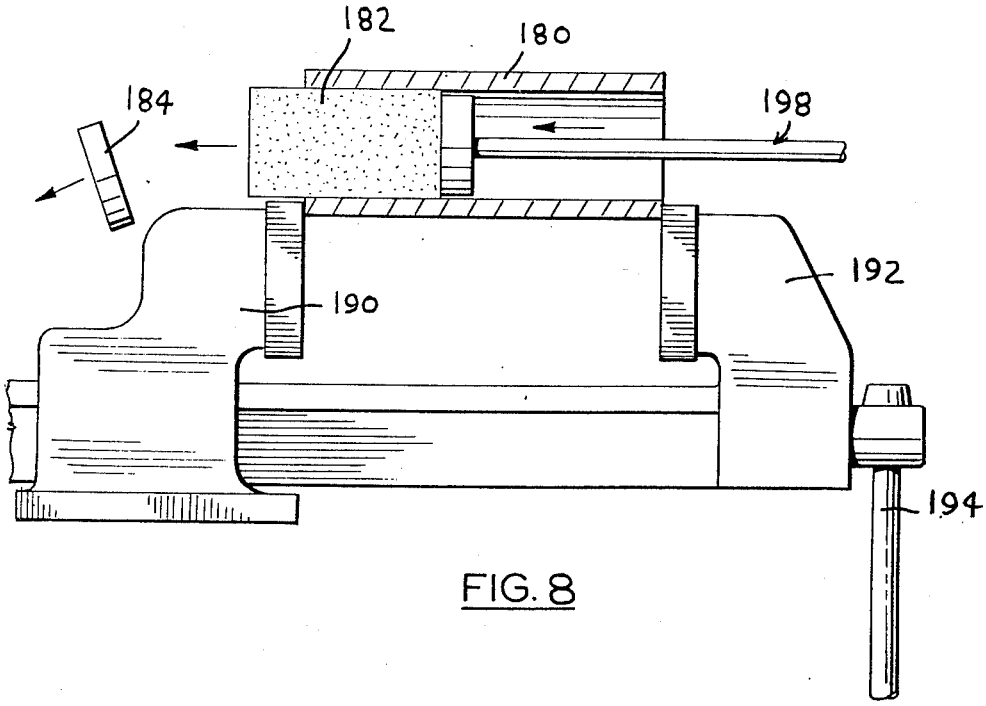

The sponge-like zinc particles produced by the method of the invention may be converted into usable zinc bars, for example, in a special furnace in which the zinc is heated in the absence of oxygen. Alternatively, according to a further feature of the invention, the melting characteristics of the zinc sponge may be improved by subjecting the sponge to sufficient pressure to consolidate the sponge particles and remove air and moisture, for example, by means of a mechanical ram acting on the zinc sponge in a cylinder. The resulting "solid" zinc slug can then be melted by conventional means. FIGS. 7 and 8 show an experimental form of apparatus which has been used in practice for consolidating zinc sponge derived from the apparatus shown in FIGS. 2, 3 and 4.

Referring to FIGS. 7 and 8, the apparatus shown in those views includes a metal cylinder 180 containing zinc sponge 182. One end of the cylinder is closed by a plug 184 which fits closely inside the end portion of the cylinder, while the opposite end of the cylinder, as seen in FIG. 7, receives a solid cylindrical piston 186. Piston 186 has a flat inner end face 188 which bears against the zinc sponge 182 in cylinder 180. Piston 186 is a sliding fit inside cylinder 180, but sufficient clearance exists between the external surface of the piston and the internal surface of cylinder 180 to allow air and moisture to leave the cylinder when the zinc sponge is compressed by the piston 186.

Compression of the zinc sponge is effected by driving piston 186 into the cylinder 180 while restraining plug 184 against outward movement. In an experimental situation, this was achieved by placing the apparatus between the jaws 190 and 192 respectively of a conventional engineers' vice. As seen in FIG. 7, the apparatus is positioned so that plug 184 is held in place by the fixed jaw 190 of the vice, while the movable jaw 192 bears against the outer end of piston 186. By turning the operating handle 194 of the vice, jaw 192 is moved towards jaw 190 driving the piston 186 into the cylinder. This causes the particles of zinc sponge 182 to be compressed and consolidated as air and moisture are driven out of the sponge between the exterior surface of piston 186 and the interior surface of cylinder 180 as indicated by the arrows 196.

When the zinc sponge has been compressed by an amount sufficient to remove as much of the air and moisture in the sponge as is practicable, piston 186 is removed from cylinder 180 and the cylinder is re-positioned between the jaws 190 and 192 of the vice as shown in FIG. 8. Thus, a portion of the wall of cylinder 180 is clamped between the jaws in a position such that the cavity in cylinder 180 is above the level of the upper surfaces of the jaws. In this position, the plug 184 is no longer restrained against movement outwardly of the cylinder and can be pushed out of the cylinder along with the zinc slug as shown in FIG. 8. This can be accomplished by manually pushing piston 186 through the cylinder or by means of a separate plunger such as that indicated at 198 which is slightly smaller than the internal diameter of cylinder 180 and which can accordingly be pushed through the cylinder more easily than piston 186.

It will be appreciated that FIGS. 7 and 8 show an experimental form of apparatus and that an apparatus of this form would not necessarily be used in practice. In a commercial installation, for example, a hydraulically powered piston and cylinder arrangement or other form of power operated press might well be used. Another alternative form of apparatus might be in the nature of a conventional pelletizing machine including a pair of contra-rotating, co-operating rolls, the exterior surfaces of which are shaped to define co-operating chambers into which the zinc sponge is poured. As the rolls rotate, the chambers of the respective rolls come together, compressing and consolidating the zinc in the chambers. In any event, it will be appreciated that many forms of apparatus may be used to perform the step of compressing and consolidating the zinc sponge to remove air and moisture.

It has also been found by applicant that the melting characteristics of the zinc sponge may be further improved by washing the zinc sponge with a weak acid before performing the step of consolidating the sponge as described previously. The reason for this is that the zinc sponge is believed to contain zinc hydrate which, if it is not removed, tends to have an inhibiting effect on the melting down of the zinc after the sponge has been consolidated. The sponge may be washed with a weak sulfuric acid solution so that any zinc hydrate in the sponge is converted into zinc sulfate, which can then be readily removed by a water wash. Another reason for using sulfuric acid is that this acid is normally readily available in a zinc processing installation. In face, spent electrolyte from the acid cell of applicant's zinc extraction apparatus may be used. Other acids may be suitable for removing zinc hydrate from the zinc sponge prior to its consolidation but may have disadvantageous side effects in terms of introducing extraneous ions. For example, hydrochloric acid would probably satisfactorily remove zinc hydrate, but would have the disadvantage of introducing chloride ions.

In any event, as indicated previously, applicant has found that a sulfuric acid wash is to be preferred. Sufficient acid should be added to the sponge to bring the pH value of the zinc sponge/acid mixture to approximately pH 5. Following the acid wash step, the zinc sponge is washed with water and filtered. The sponge is then ready to be compressed, e.g. in the apparatus of FIGS. 7 and 8.

In the particular embodiment shown in FIGS. 2 to 4 of the drawings, the zinc sponge is recovered from the alkaline cell of the apparatus in alkaline electrolyte. The zinc is filtered out of the electrolyte and water washed by re-pulping the zinc with water and refiltering. A second similar wash may then be used to remove all residual electrolyte. The acid wash is then applied to the zinc sponge to bring the mixture to pH 5. Then, the zinc is filtered from the acid solution and given a further water wash. The zinc is then ready to be subjected to mechanical pressure and consolidated as described previously. The resulting zinc slug is preferably vacuum dried. Finally, the slug can be melted by simply heating the slug, e.g. in a conventional furnace, and the resulting molten zinc formed into zinc bars.

It should be noted that the preceding description relates to particular embodiments which are referred to by way of example only, and that many modifications are possible within the broad scope of the invention. For example, the particular forms of cells described and illustrated herein will not necessarily be used commercially. It is also to be noted that other alkaline electrolytes may be used in the alkaline cell of the invention. Examples of other suitable electrolytes are potassium hydroxide solution, ammonium hydroxide solution, ammonium chloride solution and ammonium nitrate solution. The electrodes used in the various cells may be made of materials other than those specifically mentioned, as will readily be appreciated by a person skilled in the art. For example, the anode in the acid cell could be made of a lead alloy. The compound electrode and the cathode of the alkaline cell may be made of carbon, graphite, alloy steels or other electrically conductive materials which are insoluble both in the acid cell electrolyte and in the alkaline cell electrolyte. In this connection, the term "insoluble" is to be interpreted broadly as including any material which will not significantly contaminate the electrolyte in the particular situation in which it is used. Thus, there may be some situations in which a limited amount of electrolyte contamination would be tolerable.

With reference to the operation of removing zinc sponge from the cathode(s) of the alkaline cell, it is to be understood that references to "mechanically" removing the sponge are also to be interpreted broadly as including all methods of physically separating the sponge from the cathode(s) whether by scraping, hydraulic flushing or the like.

Finally, it may be useful to note the following experimental data collected during tests conducted with an apparatus such as that shown in FIGS. 2 to 4 of the drawings. As indicated previously, the voltage in the alkaline cell of the apparatus is considerably lower than the voltage in the acid cell. More specifically, the voltage in the alkaline cell would probably be in the range of one-tenth to one-third of the voltage in the acid cell. In particular experiments, the alkaline cell voltage was found to vary normally in the range 0.3 to 1.0 volts while the acid cell voltage varied in the range 3.0 to 3.5 volts. The cells were connected in series and the current was therefore identical in both cells. Experiments have been run at current densities varying from 15 to 50 amps/sq. ft. It was found that at moderate current densities, the voltage in the alkaline cell would typically remain at a low level until the stripping operation was almost complete and patches of "bare" electrode began to appear in the zinc coating on the alkaline cell anode (the common electrode), at which point a rapid rise to about 2.5 volts took place. Accordingly, it is believed that detection of a significant increase in the voltage across the alkaline cell may be used as a signal to indicate that the stripping operation is approaching its end.

What I claim is:

1. Apparatus for use in extracting primary zinc metal from an acid zinc sulfate solution derived from an ore concentrate, the apparatus comprising:

first and second electrolytic cells, the first cell being intended to receive the acid zinc sulfate solution and having an anode which is insoluble in the solution, and the second cell being intended to receive an alkaline electrolyte and having a cathode which is insoluble in said electrolyte;

said first and second electrolytic cells being defined by a common tank having an internal wall dividing said tank into first and second compartments, said first compartment being intended to receive said acid zinc sulfate solution, and said second compartment being intended to receive said alkaline electrolyte;

said acid cell having a plurality of anodes disposed in spaced positions transversely of the cell; and said alkaline cell having a corresponding plurality of cathodes disposed in spaced positions transversely of the cell corresponding generally to the positions of the anodes in the acid cell;

a plurality of common electrodes which are insoluble both in the acid zinc sulfate solution and in the alkaline electrolyte and which comprise first and second common electrodes electrically coupled together and arranged so that the first common electrodes can be disposed generally between said anodes of the acid cell and the second common electrodes can be disposed generally between said cathode of the alkaline cell, and said common electrodes can be transferred between the cells;

whereby in use, said acid zinc sulfate solution can be subjected to electrolysis in said first cell with said first common electrodes acting as cathodes, thereby causing primary zinc metal to be deposited as a coating on the electrodes, and the coated electrodes can be subsequently transferred from said first cell to said second cell in which said alkaline electrolyte can be subjected to electrolysis so that said primary zinc metal is transferred from the first common electrodes to the cathodes of the second cell in sponge-like form, from which it may be mechanically removed, and whereby said electrolysis of the zinc sulfate solution and of said alkaline electrolyte may be performed simultaneously in the respective cells so that zinc metal is deposited on electrodes in the acid cell, while previously deposited zinc is stripped from electrodes in the alkaline cell, the electrodes being transferable between the cells to permit previously coated electrodes from said acid cell to be stripped in said alkaline cell while the previously stripped electrodes from said alkaline cell are redeposited with the zinc in the acid cell.

2. Apparatus as claimed in claim 1, wherein said alkaline cell cathodes are in the form of circular discs, and wherein each of said anodes and common electrodes has the general shape of a quarter segment of a circle of a diameter corresponding to the diameter of said cathode discs, and wherein said common electrodes are disposed in the acid cell in use in positions corresponding to and directly facing the anodes of the acid cell, while the common electrodes in the alkaline cell are similarly disposed in relation to said cathode discs; and wherein the apparatus further comprises means for continuously rotating said cathode discs at relatively slow speed so that zinc sponge is deposited progressively on each disc as it rotates.

3. Apparatus as claimed in claim 2, further comprising mechanical scraper means disposed in said alkaline cell and arranged to scrape zinc sponge deposited on said cathode discs as the discs rotate; and means disposed below said discs for collecting zinc sponge removed from said cathodes by said scraper means.

4. Apparatus for use in extracting primary zinc metal from an acid zinc sulfate solution derived from an ore concentrate, the apparatus comprising:

first and second electrolytic cells, the first cell being intended to receive the acid zinc sulfate solution and having an anode which is insoluble in the solution, and the second cell being intended to receive an alkaline electrolyte and having a cathode which is insoluble in said electrolyte;

a first common electrode which is insoluble both in the acid zinc sulfate solution and in the alkaline electrolyte and which can be transferred between the first cell, in which the electrode acts as a cathode, and the second cell, in which the electrode acts as an anode;

a third electrolytic cell for containing an alkaline electrolyte and having a cathode which is insoluble in said electrolyte, said alkaline cells being connected in parallel with one another and in series with said acid cell so that a source of direct electric current connected across said cells will cause a current to flow through said acid cell at a level approximately twice the level of current flowing through each alkaline cell; and second and third common electrodes transferable between said cells;

whereby, in use, said common electrodes can be successively immersed in said acid zinc sulfate solution in said first cell and said solution subjected to electrolysis with the electrode acting as a cathode, thereby causing primary zinc metal to be deposited as a coating on the electrode, and the coated electrode can be subsequently transferred from said first cell to one of said second and third cells, and the alkaline electrolyte in said cell subjected to electrolysis so that said primary zinc metal is transferred from the electrode to the cathode of that cell in sponge-like form, from which it may be mechanically removed, the zinc deposition time in said acid cell being approximately half the stripping time for each common electrode in one of said alkaline cells.

5. Apparatus as claimed in claim 4, wherein said acid cell contains a plurality of said anodes, each coupled to a common bus bar, wherein each alkaline cell contains a corresponding plurality of cathodes connected respectively to a common cathode bar, said anodes and cathodes being in the form of plates disposed in generally vertical, horizontally spaced positions, and wherein each of said common electrodes comprises a plurality of similar plates coupled to a common electrode bus bar and adapted to be arranged in the appropriate cell in positions between the anode plates or cathode plates as the case may be.

* * * * *